US009029677B2

(12) United States Patent
Frenkel et al.

(10) Patent No.: US 9,029,677 B2
(45) Date of Patent: May 12, 2015

(54) METHOD FOR GENERATING MUSIC

(71) Applicants: Peter Frenkel, Danbury, CT (US); Alex Frenkel, Danbury, CT (US)

(72) Inventors: Peter Frenkel, Danbury, CT (US); Alex Frenkel, Danbury, CT (US)

( * ) Notice: Subject to any disclaimer, the term of this patent is extended or adjusted under 35 U.S.C. 154(b) by 186 days.

(21) Appl. No.: 13/710,187

(22) Filed: Dec. 10, 2012

(65) Prior Publication Data

US 2014/0157969 A1 Jun. 12, 2014

(51) Int. Cl.
*G04B 13/00* (2006.01)
*G10H 1/00* (2006.01)

(52) U.S. Cl.
CPC ..... *G10H 1/0025* (2013.01); *G10H 2220/351* (2013.01)

(58) Field of Classification Search
None
See application file for complete search history.

(56) References Cited

U.S. PATENT DOCUMENTS 6,743,164 B2 6/2004 Airaudi et al.
6,943,353 B2 * 9/2005 Elmore et al. ..... 250/339.02
7,247,782 B2 * 7/2007 Hennings et al. ..... 84/600
2003/0106260 A1 * 6/2003 Airaudi et al. ..... 47/58.1 LS
2004/0255757 A1 * 12/2004 Hennings et al. ..... 84/600
2010/0192754 A1 8/2010 Jung et al.
2014/0157969 A1 * 6/2014 Frenkel et al. ..... 84/609

OTHER PUBLICATIONS

Xenakis, Iannis; *Formalized Music, Thought and Mathematics in Composition*; Harmonologia Series, No. 6; Chapter VI; pp. 155-177; Pendragon Press. 1992.

* cited by examiner

*Primary Examiner* — Marlon Fletcher
(74) *Attorney, Agent, or Firm* — Dilworth IP, LLC; Frederick A. Spaeth

(57) ABSTRACT

A method for composing a musical is carried out by identifying spectral data characterizing a selected chemical composition, said spectral data representing a plurality of transmittance peaks for the selected chemical composition in a spectral range (e.g., a wave number range), including identifying the spectral range and transmittance values and positions of a sequence of transmittance peaks within the spectral range; assigning a melody duration to the identified spectral range; generating a sequence of musical tones by assigning the identified transmittance values to musical tones to the sequence of transmittance peaks; and assigning a duration to each musical tone. A computer-readable medium includes code for carrying out the method on a general-purpose computer.

14 Claims, 2 Drawing Sheets

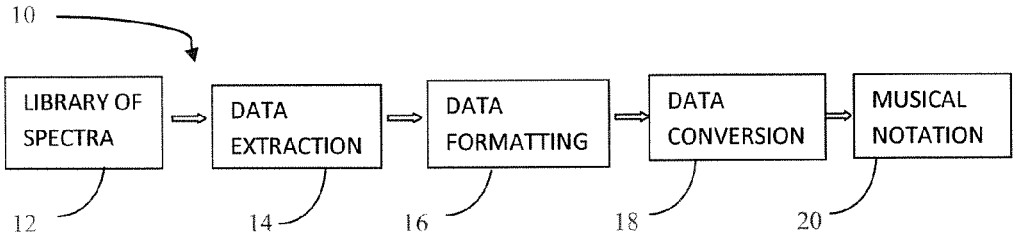
FIG. 1
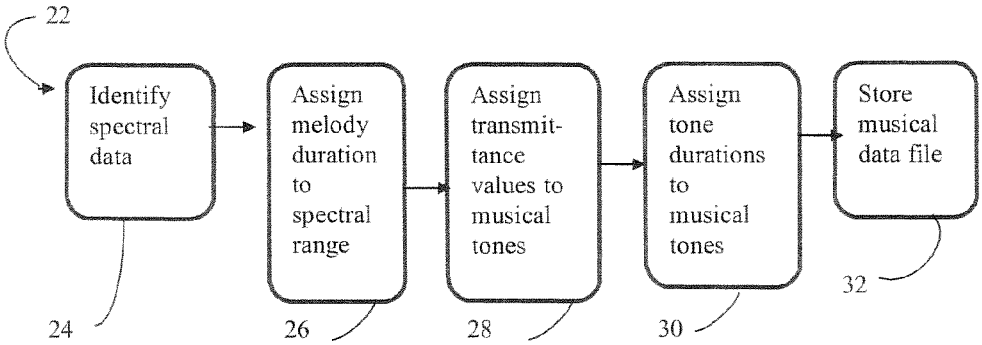
FIG. 2
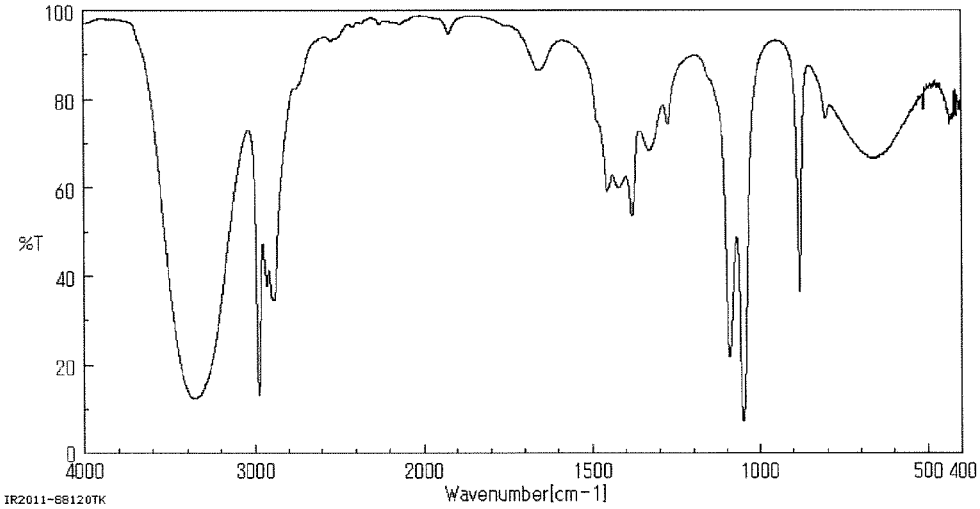
Fig. 3: FTIR spectrum of ethanol

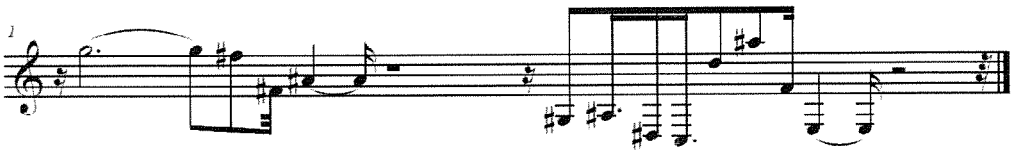
Fig. 4: Music file of ethanol based on its FTIR (Transmittance) spectra
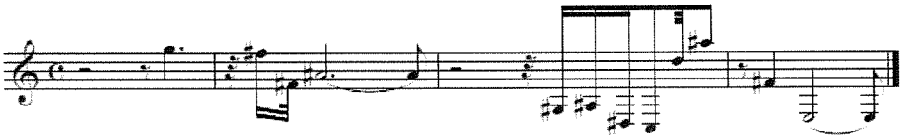
Fig. 5: Music file alternative of ethanol based on its FTIR (Transmittance) spectra
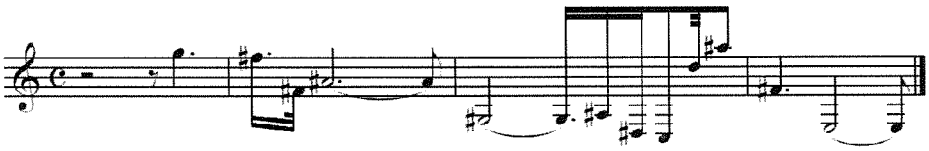
Fig. 6: Music file alternative of ethanol based on its FTIR (Transmittance) spectra

METHOD FOR GENERATING MUSIC

FIELD OF THE INVENTION

The invention relates to a method for generating music files and melodies from data that characterizes individual chemicals and their mixtures.

BACKGROUND

Several techniques have been reported for generating music based on input from bio-signals, and for obvious reasons, these methods cannot be applied to non-living objects, such as chemical substances and their mixtures.

Conventional sound source players modify music information, such as measure, rhythm and tempo using the bio-signals, such as pulse rate. Newer music players generate music directly from an Electrocardiogram (ECG) signal by matching amplitudes of the signal to the 88 keys of a piano keyboard.

U.S. Patent Application 20100192754 describes a music generation method based on two types of bio-signals: an ECG or PhotoPlethysmoGraphy (PPG). This method measures heartbeat rate signals of a user and translates heartbeat rate into a note number, heartbeat amplitude of a QRS peak into sound intensity, the difference between two subsequent heartbeat rates into a sound duration, an average heartbeat rate into a time base and measure, and rate/resolution interval increment into a number of bars.

U.S. Pat. No. 6,743,164 discloses a method of transforming micro-variations within a living organism, such as a plant, into an analog electrical signal, and generating a sequence of environmental changes perceptible through the human senses based on the analog signal. The term "micro-variations" includes electrical impedance, dielectric constant, chemical concentrations, electrochemical potential, electrochemical current, mechanical tension, force, pressure, optical transmissivity and reflectivity, chromatic value, magnetic and electrical permeability etc. The sequence of environmental changes can include the generation of music.

Genetic material of all living organisms includes deoxyribonucleic acid (DNA) sequences that consist of four different nucleotides: Adenine, Cytosine, Thymine and Guanine. Much of the DNA in an individual genome encodes twenty amino-acids. U.S. Pat. No. 7,247,782 teaches a method for musically transcribing DNA sequences comprising a) determining a sequence of amino-acids from a sequence of nucleotides, b) determining a sequence of chords in response to the determined amino-acid sequence, c) generating a sequence of tones in response to the nucleotide sequence encoding the amino-acid of each determined chord, and d) generating musical output comprised of the determined chords and tones.

Iannis Xenakis used mathematical models and equations for devising algorithms suitable for composing music [Formalized Music: Thought and Mathematics in Composition; Harmonologia Series, No. 6 (1971) by Iannis Xenakis]. The mathematical equations that were used described abstract systems and subjects such as light and probability distribution.

SUMMARY OF THE INVENTION

The present invention resides in one aspect in a method for composing a melody. The method is carried out by identifying spectral data characterizing a selected chemical composition, said spectral data having a spectral range and representing a plurality of transmittance peaks for the selected chemical composition in a spectral range, including identifying the spectral range and transmittance values and positions of a sequence of transmittance peaks within the spectral range; assigning a melody duration to the spectral range; generating a sequence of musical tones by assigning the identified transmittance values of transmittance peaks to musical tones; and assigning a tone duration to each musical tone.

According to another aspect, the invention provides a computer-readable medium comprising means for identifying spectral data characterizing a selected chemical composition, said spectral data having a spectral range and representing a plurality of transmittance peaks for the selected chemical composition in a spectral range, including identifying the spectral range and transmittance values and positions of a sequence of transmittance peaks within the spectral range; means for assigning a melody duration to the spectral range; means for generating a sequence of musical tones by assigning the identified transmittance values of transmittance peaks to musical tones; and means for assigning a tone duration to each musical tone.

BRIEF DESCRIPTION OF THE DRAWINGS

FIG. 1 is a schematic block diagram of a process according to one embodiment of the invention.

FIG. 2 is a schematic block diagram of a process according to another embodiment of the invention.

FIG. 3 is a graphic representation of an FTIR transmittance spectrum of ethanol over a wavenumber range of 4000 to 400 $cm^{-1}$.

FIG. 4 is a rendering, in standard musical notation, of musical data generated in Example 1 in accordance with a particular embodiment of the invention.

FIG. 5 is a rendering, in standard musical notation, of musical data generated from the spectrum of FIG. 3 in accordance with another embodiment of the invention.

FIG. 6 is a rendering, in standard musical notation, of musical data generated from the spectrum of FIG. 3 in accordance with yet another embodiment of the invention.

DETAILED DESCRIPTION

The present invention relates to a method for generating music. The method is based on converting analytical spectral data of physical-chemical properties of a chemical composition comprising one or more chemical compounds into musical data representing a series of musical tones and durations, i.e., into data representing a melody, by identifying the spectral range, assigning a melody duration to the spectral range, and assigning musical tones and tone durations to peak measurement values in a spectral range.

In general, spectral data represents measured values for a physical characteristic of the chemical composition over a selected spectrum, including a series of peak values having particular positions in the spectrum and, in some embodiments, widths. The composition may consist of a single chemical compound, e.g., ethanol (CH3CH2OH), or a combination of chemical compounds. The spectral data may be obtained from a stored record of a spectral analysis of the composition, and may be in numerical or graphic form. Instrumental analytical spectrometric techniques that may provide such data include but are not limited to infra-red spectroscopy (including FTIR), UV-spectroscopy, Raman-spectroscopy, X-ray spectroscopy, Nuclear Magnetic Resonance spectroscopy, thermogravimetric analysis and combinations thereof, all of which are known in the art, as seen, for example, in "Spectrometric Identification of Organic Compounds"; 7th edition by Robert M. Silverstein, Francis X. Webster, David Kiemle; John Wiley & Sons, 2005. The invention is not limited in this regard and in various embodiments, any selected analytical spectral data may be used. For purposes of description herein, the range over which measurement data is provided (e.g., a range of wave numbers) is sometimes referred to herein as the "spectral range" or as "x-axis" data and the magnitude of measured data is sometimes referred to herein as "measurement peak values" or "y-axis" data.

In accordance with one embodiment of the invention, a melody duration is assigned to the spectral range of x-axis data for the spectrum of the chemical composition as a data formatting function, and musical tones are assigned to a plurality of measurement peaks within the spectral range and a tone duration is assigned to each musical tone as data conversion functions. Pursuant to data conversion, a musical tone may be assigned to a measured peak value in accordance with the relative magnitude of the measurement peak value, i.e., in accordance with the y-axis magnitude of the measured peak value. In one embodiment, measurement peaks can be assigned to musical tones by assigning a benchmark transmittance/absorbance value (i.e., a benchmark y-axis value) to an anchor musical tone and assigning an incremental deviation from the benchmark to a scale interval. For example, a 50% transmittance value may be assigned the anchor musical tone and a selected deviance therefrom, e.g., each 2% change in transmittance/absorbance value, may be assigned a scale interval from the anchor musical tone. The anchor musical tone and deviance corresponding to a scale interval are selected so that via data conversion the spectral data provide a range of musical tones. In one embodiment, the musical tones assigned to the measurement peaks are assigned a sequence corresponding to the sequence of measured peak values in relation to the x-axis data.

In one embodiment, a melody duration is assigned to the entire spectral range and musical tones are assigned tone durations within the melody duration. Optionally, a tone duration may be assigned to a musical tone according to the position in the spectral range at which the measurement peak for that tone occurred, i.e., in accordance with the x-axis location of the measurement peak in the spectral range. In one embodiment, the duration of the musical tone may be dependent on the width of the measurement peak along the x-axis taken at a selected y-axis value, e.g., the x-axis width taken at 100% y-axis value of the measurement peak, or at 50% y-axis value of the measurement peak, or at some other % measurement threshold. Optionally, the melody duration assigned to the spectral range may be assigned a time signature and the spectral range may be divided into one or more measures. In such case, the tone duration of the last musical tone in a measure may optionally terminate at the end of that measure. The x-axis region from the start of a measure to the next measured peak may be assigned to a musical rest and the x-axis region between measurement peaks may be assigned a musical rest. Optionally, a musical rest may be avoided by extending the duration of the next musical tone backward to over-write part or all of the musical rest. In one embodiment, a tone duration and/or a musical rest is rounded to the nearest whole, half, quarter, sixteenth, thirty-second or sixty-fourth note value, or to the nearest combination thereof.

As indicated above, a variety of type of spectral data can be translated into musical tones. For example, infrared spectroscopy of a composition yields an infrared spectrum with absorption peaks which correspond to the frequencies of vibrations between the bonds of the atoms making up the material. FT-IR stands for Fourier Transform Infra-Red, a preferred non-destructive method of infrared spectroscopy. In infrared spectroscopy, a selected range of IR radiation is passed through a sample composition. Some of the infrared radiation is absorbed by the sample and some of it is passed through (transmitted), and the intensity of the transmitted signal is measured. The resulting measured values provide spectral data which represents the molecular absorption or transmission of the sample over the selected range, creating a molecular fingerprint of the sample. Like a fingerprint, no two unique molecular structures produce the same infrared spectrum because each different material is a unique combination of atoms. Mixtures of several compounds have frequencies of the individual components; however, percent transmittance is dependent upon the concentration of those components. A typical IR spectrum consists of a set of frequencies (x-axis data that characterize vibrations between the chemical bonds) and their intensities (y-axis data indicating percent transmittance or absorbance).

Nuclear magnetic resonance (NMR) occurs when the nuclei of certain atoms are immersed in a static magnetic field and exposed to a second oscillating magnetic field. Some nuclei experience this phenomenon, and others do not, dependent upon whether they possess a property called spin. Nuclear magnetic resonance spectroscopy is the use of the NMR phenomenon to study physical, chemical, and biological properties of matter. This technique relies on the ability of atomic nuclei to behave like a small magnet and align themselves with an external magnetic field. When irradiated with a radio frequency signal, the nuclei in a molecule can change from being aligned with the magnetic field to being opposed to it. Therefore, it is called "nuclear" for the instrument works on stimulating the "nuclei" of the atoms to absorb radio waves. The energy frequency at which this occurs can be measured and is displayed as an NMR spectrum. An NMR spectrum appears as a series of vertical peaks/signals of various intensities (y-axis data) at the selected energy frequencies (x-axis data) that can be used for music generation in accordance with the invention.

In X-Ray Spectroscopy, X-ray emission and absorption spectra are used for investigating the electronic energy structure of chemical compositions such as atoms, molecules, and materials. The emission spectra are detected by means of X-ray spectrometers, and their investigation is based on the dependence of the radiation intensity of the energy of the X-ray photons. The shape and region of X-ray emission spectra give information on the energy distribution of the state density of valence electrons in a solid material. An X-ray absorption spectrum is formed when a narrow section of the X-ray radiation is transmitted through a thin layer of the tested solid sample composition. The output (X-ray spectra) shows a series of peaks of various intensities (y-axis data) at various frequencies (x-axis data) that can be used for music generation in accordance with the present invention.

In another embodiment, thermo-gravimetric analysis can also be used to generate data for conversion into music in accordance with this invention. In such case, a sequence of peaks represents the weight loss of a chemical composition over a temperature range; a musical tone is assigned to each weight loss value (y-axis); the temperature range of the analysis is the x-axis data which is assigned a melody duration.

Optionally, spectral data can be rotated (90 degrees, for example) and/or further derivatized (inverted, for example) mathematically or graphically to generate alternative versions of the musical composition.

In a particular embodiment, the spectral data includes x-axis data and y-axis data and the spectral range is defined in terms of x-axis data, and the method comprises assigning an y-axis value to be an anchor value and assigning the y-axis anchor value to an anchor scale tone, and selecting an incremental variance of y-axis data from the y-axis anchor value to correspond to a scale interval. The method may also include identifying a first y-axis value of a first transmittance peak and calculating the variance of the first y-axis value from the y-axis anchor value and assigning the first transmittance peak to a scale tone at an interval from the anchor tone based on the number of incremental variances there are between the first y-axis value and the y-axis anchor value.

In another optional aspect of the invention, the method may include selecting a y-axis duration set point and assigning to a scale tone for a peak a duration corresponding to the relative width of the peak at the y-axis duration set point in relation to the spectral range. For example, if the width of a peak at the selected y-axis duration set point is 1% of the spectral range, the tone assigned to that peak may have a duration of 1% of the melody duration assigned to the spectral range. However, the invention is not limited in this regard and in other embodiments, other methods for assigning a duration to a note may be used.

In an illustrative embodiment, music is generated from the infrared spectrum of a chemical composition, in which a 50% transmittance value is assigned to the musical tone middle C (C4; approximately 262 Hz) and a 2% deviance therefrom is assigned a half-step scale interval in a 12-tone chromatic scale. Accordingly, a 52% transmittance value corresponds to the musical tone C# and a 68% transmittance value would be assigned the musical tone nine (9) half scale steps above the anchor note, i.e., A above middle C (about 440 Hz). An actual transmittance value, if not corresponding precisely to the anchor note or to a scale interval from the anchor note, can be rounded to the nearest deviance which does correspond to the anchor note or to a scale interval from the anchor note. Thus, a transmittance value of 51.75% can be rounded to the musical tone $C^{\#}$. Optionally, rounding may be directed upward or downward by reference to note assigned to the preceding measurement peak, e.g., either farther from, or closer to, the preceding note. For example, if a particular transmission/absorbance value falls between two musical tones but is higher than the previously assigned tones, the transmittance value may be rounded upward, away from the preceding note, and if it is lower than the preceding note, may be rounded downward, again away from the preceding note. Optionally, a threshold absorbance/transmittance value may be set, below which any reported value is not assigned a musical tone but rather a musical rest.

The invention is not limited in to the scale, anchor note and deviance attributed to a scale interval described above, and in other embodiments, any desired anchor note may be chosen, any desired deviance may be assigned to correspond to a half-step scale interval, a scale other than a 12-tone chromatic scale may be used, etc. In yet another embodiment, selected bands of transmission/absorbance values are simply mapped to respective musical tones, and the transmission/absorbance value of each peak is assigned to a musical tone according to the band in which it is located.

In one embodiment, the entire spectral range of the data is assigned a melody duration. For example, a typical spectral range for an FTIR spectrum is from zero to 4000 $cm^{-1}$, which may be assigned a melody duration of 1 second, and the tone durations of measurement peaks therein may be scaled proportionately (linearly) to their respective widths. In one embodiment, the wave number distance from one end of the spectrum to the first peak represents a time interval of no sound, i.e., a musical rest. The wave number distance from the first peak to the second peak represents the tone duration of the first tone, the wave number distance from the second peak to the third peak represents the tone duration of the second tone, etc. In another embodiment, duration of an assigned musical tone or rest is based on the width of measurement peak or spectral band assigned to that musical tone or rest, measured along the x-axis and taken in proportion to the melody duration.

FIG. 1 illustrates a process of music generation 10 according to one embodiment of the present invention. According to this invention, the music generation process 10 includes providing a chemical-physical data (spectral data) source 12, in this case a library of spectra or raw data on chemical compounds or mixtures of compounds, including materials. A process of data extraction in Step 14 provides peak data values for a selected chemical material with a spectral range, i.e., x-axis data of relative peak positions and y-axis data of amplitudes indicating a % absorbance or transmittance. A data formatting in Step 16 allows mapping of the X-axis range of spectral data to a melody duration, optionally expressed in milliseconds (proportional to the units on the X-axis of the spectra) and the Y-axis of the absorbance/transmittance peak data to chromatically sequential pitch values. Data conversion of the peak amplitudes and their corresponding maximum values to musical tones and their respective tone durations is performed in Step 18, yielding musical data. The musical data may be stored as a conventional music file, e.g., in MIDI format or any other known format. Optionally, the musical data is converted to conventional musical notation as a melody on a music staff in Step 20.

In another embodiment, a process for carrying out the invention is embodied in a computer-readable medium, such as a CD ROM or DVD. The computer-readable medium comprises code which can be executed on a general purpose computer for carrying out an algorithm as depicted at 22 in FIG. 2. There is code for a Step 24 of identifying spectral data characterizing a selected chemical composition, said spectral data representing a plurality of transmittance peaks for the selected chemical composition in a wave number range, including identifying the spectral range and transmittance values and wave number positions of a sequence of transmittance peaks within the spectral range. There is also code for a Step 26 of data formatting, for assigning a melody duration to the identified wave number range. There is code for data conversion, including code for a Step 28 of generating data representing a sequence of musical tones by assigning the identified transmittance values to musical tones in the sequence of transmittance peaks, and code for a Step 30 for assigning a tone duration to each musical tone. The sequence of tones and their durations are stored in Step 32 as a musical data file, which can optionally be converted into written notation using well-known software.

In one embodiment, there is code for a process of allowing a user to select a chemical composition and for accessing a library of spectral data to acquire spectrographic data for the selected composition, including the x-axis positions of peak values, in Step 24. In a particular embodiment there is code for a process of converting graphical spectral data to digital spectral data for Step 24. Optionally, there is code for a process of mapping spectral peak amplitude to musical tones for Step 28. In one embodiment, the code allows a user to specify an anchor musical tone for a selected transmission/absorbance and to select an amplitude differential to correspond to a scale interval. In yet another embodiment, the code for Step 24 allows a user to assign a time signature to the musical tones. Optionally, the computer-readable medium includes code for creating audio signals for playing the melody, and/or code for rendering the data as standard musical notation on a musical staff.

In another embodiment, an integrated circuit (e.g., an ASIC (application specific integrated circuit) or an EPROM) is configured to execute steps as described in connection with FIG. 2. Optionally the circuit may be configured to allow a user to store the music file. The integrated circuit may be optionally be configured (e.g., programmed) to interface with a spectrometric device in order to receive the spectral data.

In another embodiment, the correlation between spectra data and musical tones can be established using Cartesian graph paper and available music notation software.

Example 1

This example below illustrates one embodiment for generating music from FTIR spectral data from ethanol depicted in FIG. 3.

For the purpose of this example, the spectral range of wavenumbers 4,000 to 0 $cm^{-1}$ was set to correspond to a melody duration of 4000 milliseconds divided equally into sixteen beats without a time signature (free form), while 50% transmittance was set to correspond to the anchor musical tone middle C on the piano keyboard (C4) and every 2% variance signified a specific scale interval, in this case a half-step in a twelve-tone chromatic scale. A peak point which does not fall precisely on a scale tone is then rounded to the nearest pitch based on the preceding peak point. Specifically, if the preceding peak is lower than the previous peak, it is rounded up to the nearest scale tone. If the preceding peak is higher, it is rounded down to the nearest scale tone. The first peak may be rounded, if necessary, either up or down. All note/rest durations were approximated as shown in Table 1.

In the example, one whole note is assigned to represent a duration of 1000 milliseconds (ms) (i.e., four beats), a half note equals 500 ms, a quarter note equals 250 ms, an eighth note equals 125 ms, a sixteenth note equals 62.5 ms, a thirty-second note equals 31.25 ms, and a sixty-fourth note equals 15.625 ms. The distance between the beginning of the measure and the initial incline of the first peak is 80 ms. The initial incline begins the first peak that is described in the table of the FTIR spectrum. That value is rounded down to 62.5 ms (which is made up of a sixteenth note/rest duration). The duration of each note within the measure is assigned by measuring and converting the width of each peak, from valley to valley, into a duration (in milliseconds (ms)) and rounding to the nearest note/rest duration (whole note, half-note, etc.). Any space between peaks is deemed a rest, and its duration is measured analogously: from the ending of the preceding peak to the beginning of the following peak, rounded to the nearest note/rest duration. Based on the analytical instrument settings, certain small peaks may still be found in the music rest region.

Results of converting FTIR data into a note sequence and a musical file are in the Table 1 below.

TABLE 1

| % Transmittance | Pitch | Wavenumber, $cm^{-1}$ | Sound Duration, milliseconds | Sound Duration, beats |
|---|---|---|---|---|
| — | Rest | — | 80 | 0.25 |
| 88 | G5 | 3358 | 880 | 3.5 |
| 87 | F#5 | 2974 | 100 | 0.5 |
| 62 | F#4 | 2927 | 40 | 0.125 |
| 65 | A#4 | 2887 | 320 | 1.25 |
| — | Rest | — | 1085 | 4.25 |

TABLE 1-continued

| % Transmittance | Pitch | Wavenumber, $cm^{-1}$ | Sound Duration, milliseconds | Sound Duration, beats |
|---|---|---|---|---|
| 41 | G#3 | 1455 | 144 | 0.5 |
| 46 | A#3 | 1381 | 93 | 0.375 |
| 32 | D#3 | 1330 | 62 | 0.25 |
| 26 | C3 | 1274 | 93 | 0.375 |
| 78 | D5 | 1090 | 134 | 0.5 |
| 93 | A#3 | 1050 | 144 | 0.5 |
| 63 | F#4 | 881 | 82 | 0.25 |
| 33 | E3 | 669 | 340 | 1.25 |
| — | Rest | — | 524 | 2.125 |

The data of Table 1 is presented in FIG. 4 in standard musical notation as a sequence of musical notes of assigned durations, i.e., a melody, on a music staff.

Example 2

This example below illustrates another embodiment for generating music from FTIR spectral data from ethanol depicted in FIG. 3.

For the purpose of this example, the spectral range of wavenumbers 4,000 to 0 $cm^{-1}$ was set to correspond to a melody duration of 4000 milliseconds broken up equally into four measures in the time signature of 4/4 (four beats per measure with a quarter note getting one beat, yielding sixteen beats from measure 1, beat 1 to measure 4, beat 4), while 50% absorbance was set to correspond to the anchor musical tone middle C on the piano keyboard (C4) and every 2% increase or decrease in absorbance signified a respective half-step on the piano keyboard.

In the example, one whole note equals 1000 milliseconds (ms) (four beats), a half note equals 500 ms, a quarter note equals 250 ms, an eighth note equals 125 ms, a sixteenth note equals 62.5 ms, a thirty-second note equals 31.25 ms, and a sixty-fourth note equals 15.625 ms. Since there is no transmission/absorbance peak at a wave number corresponding to the start of any measure, the beginning of each measure starts with a rest or a combination of rests. This is calculated by measuring the distance (in ms) between the very beginning of the measure and the first actual note that is graphed. The distance is then rounded to the nearest note/rest duration value(s), which correspond to note durations (whole note rest (1000 ms), half note rest (500 ms), etc.). In Example 2, the distance between the beginning of the first measure and the actual first note in that measure is 642 $cm^{-1}$, which corresponds to 642 ms. That value is rounded down to 625 ms (which is made up of a half note/rest duration and an eighth note/rest duration). All other notes and their durations can be approximated accordingly. The last note in each calculated measure carries on until the end of said measure. The distance between notes within each measure is calculated the same way, i.e., the distance (in ms) between consecutive peaks is noted and is rounded to the nearest note/rest duration.

Since every 2% of transmittance equals a half-step interval on the piano keyboard, if a peak point does not fall precisely on a pitch, the peak point is then rounded to the nearest pitch. In one embodiment, rounding of a peak point is based on the preceding peak point as follows: if the preceding peak is lower, the composer rounds up to the nearest pitch, and if the preceding peak is higher, the composer rounds down to the nearest pitch.

Results of converting FTIR data into a note sequence and a musical file are in the Table 2 below.

TABLE 2

| Wavenumber, cm−1 | Absorbance, % | Note/ Pitch | Duration (in beats) | Measure No. |
|---|---|---|---|---|
| 4000 | 0 | Rest | 2.5 (½ note + ⅛ note) | 1 |
| 3358 | 88 | G5 | 1.5 (dotted ¼ note) | |
| 3000 | 0 | Rest | 0.125 (1/32 note) | 2 |
| 2974 | 87 | F#5 | 0.25 (1/16 note) | |
| 2927 | 62 | F#4 | 0.125 (1/32 note) | |
| 2887 | 65 | A#4 | 3.5 (dotted ½ note + ⅛ note) | |
| 2000 | 0 | Rest | 2.125 (½ note + 1/32 note) | 3 |
| 1455 | 41 | G#3 | 0.25 (1/16 note) | |
| 1381 | 46 | A#3 | 0.25 (1/16 note) | |
| 1330 | 32 | D#3 | 0.25 (1/16 note) | |
| 1274 | 26 | C3 | 0.5 (⅛ note) | |
| 1090 | 78 | D5 | 0.125 (1/32 note) | |
| 1050 | 93 | A#5 | 0.5 (⅛ note) | |
| 1000 | 0 | Rest | 0.5 (⅛ note) | 4 |
| 881 | 63 | F#4 | 1.0 (¼ note) | |
| 669 | 33 | E3 | 2.5 (½ note + ⅛ note) | |

The data of Table 2 is presented in FIG. 5 in standard musical notation as a sequence of musical notes of assigned durations, i.e., a melody, on a music staff.

As an alternative to having rests at the beginning of each measure (excluding the very first measure of the piece), the user may replace the calculated rest with the note that follows it (the first calculated note of the measure) and tie both notes together, as indicated in the second, third and fourth measures of FIG. 6.

In another embodiment, the invention provides a method for musically transcribing individual chemical substances and their mixtures comprising steps of a) generation or acquisition of analytical chemical-physical data on a chemical substance or a mixture of substances, including materials, in a graphical, such spectra, or numerical format, comprising a number of peaks of measured values and amplitudes, b) data extraction that extracts the information, such as peak values and their amplitudes into a numerical file, c) data formatting that formats the X-axis and Y-axis of the spectra to the duration and rhythmic break-up of the composition and chromatically sequential pitch values, d) data conversion that converts peak values and their corresponding amplitude or peak width at half height to a pitch and a sound duration and e) musical notation that displays the determined sequence of pitches of certain durations as a melody on the music staff.

The terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure, that numerous variations and alterations to the disclosed embodiments will fall within the scope of this invention and of the appended claims.

What is claimed is:

1. A method for composing a melody, comprising:

receiving spectral data characterizing a selected chemical composition, said spectral data having a spectral range and representing a plurality of transmittance peaks for the selected chemical composition in a spectral range;

identifying the spectral range and transmittance values and positions of a sequence of transmittance peaks within the spectral range;

assigning a melody duration to the spectral range;

generating a sequence of musical tones by assigning the identified transmittance values of transmittance peaks to musical tones; and assigning a tone duration to each musical tone.

2. The method of claim 1 wherein the spectral data comprises one or more of infra-red spectroscopy data, UV-spectroscopy data, mass-spectroscopy data, Raman-spectroscopy data, X-ray spectroscopy data, Nuclear Magnetic Resonance spectroscopy data, thermogravimetric analysis data and combinations thereof.

3. The method of claim 1, comprising accessing a library of spectra.

4. The method of claim 1, comprising assigning a time signature to the melody.

5. The method of claim 1, comprising carrying out a spectral analysis on the chemical composition to provide the spectral data.

6. The method of claim 5, comprising providing the spectral data in graphical format as graphical spectral data, and further comprising converting the graphical spectral data to digital spectral data.

7. The method of claim 1, comprising obtaining spectral data in a graphical format.

8. The method of claim 1 where the spectral data is rotated 90 degrees to generate an alternative version of the musical composition.

9. The method of claim 1 wherein the spectral data includes x-axis data and y-axis data and the spectral range is defined in terms of x-axis data, and the method comprises assigning an y-axis value to be an anchor value and assigning the y-axis anchor value to an anchor scale tone, and selecting an incremental variance of y-axis data from the y-axis anchor value to correspond to a scale interval; and identifying a first y-axis value of a first transmittance peak and calculating the variance of the first y-axis value from the y-axis anchor value and assigning the first transmittance peak to a scale tone at an interval from the anchor tone based on the number of incremental variances there are between the first y-axis value and the y-axis anchor value.

10. The method of claim 9 including selecting a y-axis duration set point and assigning to a scale tone a duration corresponding to the relative width of the peak at the y-axis duration set point in relation to the spectral range.

11. The method of claim 1 including selecting a y-axis duration set point and assigning to a scale tone for a peak a duration corresponding to the relative width of the peak at the y-axis duration set point in relation to the spectral range.

12. A computer-readable medium comprising:

means for acquiring spectral data characterizing a selected chemical composition, said spectral data having a spectral range and representing a plurality of transmittance peaks for the selected chemical composition in a spectral range, including identifying the spectral range and transmittance values and positions of a sequence of transmittance peaks within the spectral range;

means for assigning a melody duration to the spectral range;

means for generating a sequence of musical tones by assigning the identified transmittance values of transmittance peaks to musical tones; and means for assigning a tone duration to each musical tone.

13. The computer-readable medium of claim 12, including means for identifying spectral data that comprises one or more of infra-red spectroscopy data, UV-spectroscopy data, mass-spectroscopy data, Raman-spectroscopy data, X-ray spectroscopy data, Nuclear Magnetic Resonance spectroscopy data, thermogravimetric analysis data and combinations thereof.

14. The computer-readable medium of claim 12, wherein the spectral data includes x-axis data and y-axis data and the spectral range is defined in terms of x-axis data, and the computer-readable medium comprises means for assigning an y-axis value to be an anchor value and assigning the y-axis anchor value to an anchor scale tone;

means for selecting an incremental variance of y-axis data from the y-axis anchor value to correspond to a scale interval; and means for identifying a first y-axis value of a first transmittance peak and calculating the variance of the first y-axis value from the y-axis anchor value and for assigning the first transmittance peak to a scale tone at an interval from the anchor tone based on the number of incremental variances there are between the first y-axis value and the y-axis anchor value.

* * * * *